US006736391B1

(12) United States Patent
Reist

(10) Patent No.: US 6,736,391 B1
(45) Date of Patent: May 18, 2004

(54) METHOD AND APPARATUS FOR FURTHER CONVEYANCE OF FLAT OBJECTS ARRIVING IN A LAMELLAR FLOW

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/698,688

(22) PCT Filed: Feb. 16, 1999

(86) PCT No.: PCT/CH99/00072

§ 371 (c)(1),
(2), (4) Date: Oct. 27, 2000

(87) PCT Pub. No.: WO99/55609

PCT Pub. Date: Nov. 4, 1999

(30) Foreign Application Priority Data

Apr. 28, 1998 (CH) ..... 0952/98

(51) Int. Cl.[7] ..... B65H 29/04

(52) U.S. Cl. ..... 271/205; 101/408; 198/644

(58) Field of Search ..... 271/252, 237, 271/204–206, 3.18, 3.24; 198/644, 470.1, 867, 867.1, 803.7, 803.9, 462.2, 596, 803.3, 803.4; 101/408; 209/903

(56) References Cited

U.S. PATENT DOCUMENTS

| | | | | |
|---|---|---|---|---|
| 4,512,457 A | | 4/1985 | Reist et al. | |
| 4,569,488 A | * | 2/1986 | Baltisberger | 198/347.3 |
| 4,678,172 A | * | 7/1987 | Faltin | 198/440 |
| 4,887,809 A | | 12/1989 | Eberle | |
| 4,953,847 A | | 9/1990 | Honegger | |

FOREIGN PATENT DOCUMENTS

| | | | |
|---|---|---|---|
| DE | 2417612 | * | 3/1974 |
| FR | 1 115 297 A | | 4/1956 |

* cited by examiner

*Primary Examiner*—Donald P. Walsh
*Assistant Examiner*—Kenneth W Bower
(74) *Attorney, Agent, or Firm*—Brinks Hofer Gilson & Lione

(57) ABSTRACT

In each case at least two objects arriving in a lamellar flow (14) are grasped from the side by a conveyor clamp (22) and conveyed further while maintaining their mutual position. The at least two objects forming a section are held by a single conveyor clamp in a clamping area (30) where the objects (14) overlap.

13 Claims, 6 Drawing Sheets

METHOD AND APPARATUS FOR FURTHER CONVEYANCE OF FLAT OBJECTS ARRIVING IN A LAMELLAR FLOW

RELATED APPLICATIONS

This application is the National Stage of International Application No. PCT/CH99/00072, filed Feb. 16, 1999, which claims priority to Swiss Application No. 0952/98, filed Apr. 28, 1998.

The present invention relates to a process and to an apparatus for the further conveyance of sheet-like articles, such as printed products, arriving in an imbricated stream according to the preamble of claims 1 and 5, respectively.

A process and an apparatus of this type are know from U.S. Pat. No. 4,953,847.

Printed products arranged in a regular imbricated formation are conveyed, by means of a feed conveyor designed as a belt conveyor, to a receiving region arranged at the end of the belt conveyor. A conveying device with transporting clamps arranged at equal distances one behind the other on a drawing element leads past the end of the belt conveyor with an upward or downward slope. The conveying speeds of the belt conveyor and of the conveying device are co-ordinated with one another such that in each case two printed products fed are introduced into an open transporting clamp with their leading edges in front. The depth of the transporting clamps is greater than the distance between the leading edges of the printed products in the imbricated formation fed, with the result that the two printed products gripped by a transporting clamp can be gripped, and conveyed further, with their positioning relative to one another unchanged.

The depth of the transporting clamps thus has to be co-ordinated with the distance between the leading edges of the printed products. If it is intended, with the same distance between the leading edges, to grip more than two printed products using one transporting clamp, this requires transporting clamps of correspondingly larger design. In order to guarantee reliable introduction of the printed products into the transporting clamps, the feed conveyor and the conveying device have to be correspondingly co-ordinated with one another.

The object of the present invention is thus to provide a process of the generic type and an apparatus of the generic type in which said disadvantages are eliminated. Furthermore, the process and the apparatus according to the invention are intended to allow the articles to be conveyed around bends in the conveying surface thereof.

A single transporting clamp grips in each case at least two of the fed articles from one side. It is thus permissible to have considerable tolerances both in the distance between the leading edges of the articles in the imbricated stream fed and in the synchronization between the feed conveyor and the conveying device. A transporting clamp may receive a different number of articles as well as articles with different distances between the leading edges. All that is required is for each article to come to rest with a region in the active region of the transporting clamps. The articles which are secured relative to one another by a transporting clamp and form a section can also be moved in the conveying surface in relation to the leading and trailing sections; this allows the articles to be conveyed—while maintaining the overlapping of the sections—around bends, even in the plane or surface defined by the sections.

Preferred developments of the process according to the invention and embodiments of the apparatus according to the invention are specified in the dependent claims.

The invention will be described in more detail with reference to embodiments illustrated in the drawing, in which, purely schematically:

Figure 1:
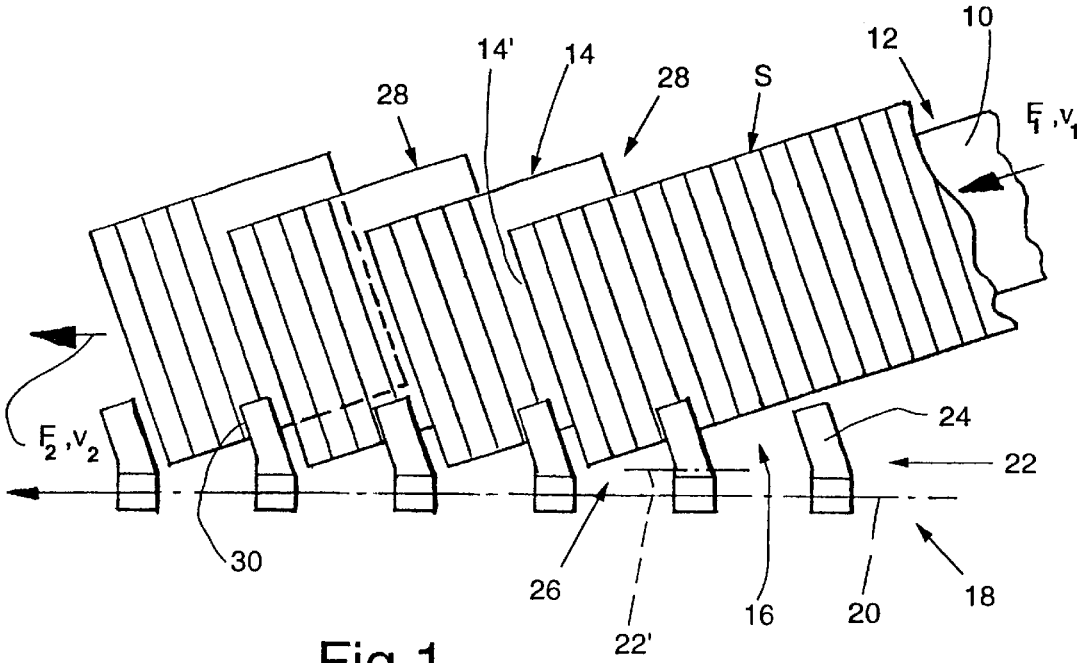
FIG. 1 shows a plan view of a first embodiment of the apparatus, in which the imbricated stream is fed obliquely in relation to the conveying direction of the transporting clamp, and each transporting clamp grips a section of the imbricated stream, while the positioning of the articles is maintained.

The apparatus shown in FIG. 1 has a feed conveyor 12 which is designed as a belt conveyor 10. It is driven continuously at a speed $v_1$ in the feed direction $F_1$ and is intended for conveying flexible, sheet-like articles, in the present case printed products such as newspapers, periodicals or the like, arranged in the an imbricated formation S to a receiving region 16 at the downstream end of the belt conveyor 10. In the imbricated formation S, each article 14 rests on the respectively preceding one and the leading edge 14' of the articles 14 runs at right angles to the feed direction $F_1$.

A conveying device 18 has transporting clamps 22 arranged at regular intervals one behind the other on a drawing element 20 which is driven continuously in circulation at a speed $v_2$ in the conveying direction $F_2$. The movement path 22' of said transporting clamps is located on that side of the receiving region 16 which is designated 26, in the conveying plane defined by the belt conveyor 10, and the two conveying directions $F_1$ and $F_2$ enclose an acute angle. That component of the speed $v_1$ of the feed conveyor 12 which is measured in the conveying direction $F_2$ of the conveying device 18 corresponds to the conveying speed $v_2$ of the conveying device 18.

The apparatus shown in FIG. 1 functions as follows. The open transporting clamps 22 are moved one after the other into the receiving region 16, where, by way of their clamp tongues 24, they enclose a certain number of, in the present case 5, articles 14 from the left-hand side 26, as seen in the feed direction $F_1$, grip said articles 14 by virtue of the clamp tongues 24 being displaced into the closed position, and convey said articles further in the conveying direction $F_2$ while the articles maintain their positioning relative to one another. The articles 14 gripped and retained by a transporting clamp 22 constitute a section 28 of the original imbricated formation S. The lateral clamping region 30, in which the articles 14 are secured, is located at the leading edge 14' of the respectively rearmost article 14 of a section 28. In this clamping region 30, all the articles 14 of the second 28 overlap, the foremost article 14 being spaced apart from the leading edge 14' thereof and the rearmost article 14 being retained at the leading edge 14'. At least part of the overlapping—as seen in the conveying direction $F_2$—of all the articles 14 of the section is located in the clamping region 30. In the closed position of the transporting clamps 22, the clamp tongues 24 run parallel to the leading edge 14' of the articles 14.

Figure 2:
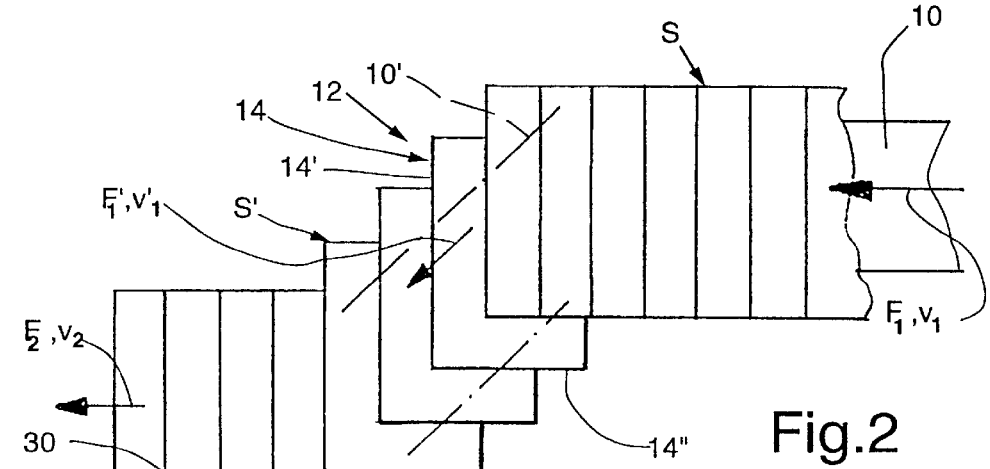
FIG. 2 shows a plan view of a second embodiment of the apparatus, in which the imbricated stream is deflected in order to feed the articles to the transporting clamps with a movement component in the direction of the same.
Figure 3:
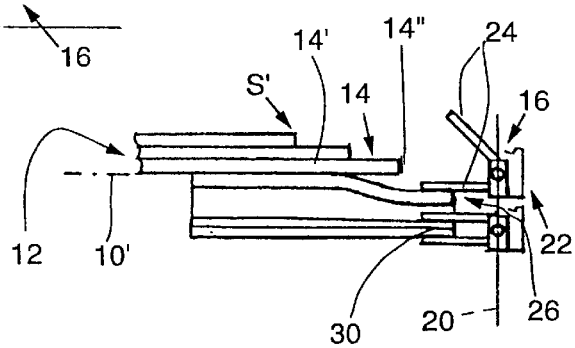
FIG. 3 shows a view, in the direction of the arrow III of FIG. 2, of part of the apparatus shown there.

In the apparatus shown in FIGS. 2 and 3, the feed conveyor 12 has a belt conveyor 10 and a strap conveyor 10' which is arranged downstream of the belt conveyor and of which the conveying direction $F_1'$ runs obliquely in relation to the conveying direction $F_1$ of the belt conveyor 10. The belt conveyor 10 is intended for feeding to the strap conveyor 10' the articles in an imbricated formation S in which each article 14 rests on the respectively preceding one and the leading edges 14' run at right angles to the conveying direction $F_1$, said strap conveyor, on account of its oblique positioning forming a "diagonal imbricated formation" S' from the articles 14 arriving, in which diagonal imbricated formation the corresponding edges of the articles 14 are still arranged parallel, but successive articles 14 are offset approximately in the direction of the diagonals of the articles.

The strap conveyor 10' is intended for feeding the articles 14, in the diagonal imbricated formation S', to the receiving region 16, which is located at the downstream end of the strap conveyor 10' and past which, in turn, the movement path of the transporting clamps 22 of the conveying device 18 runs on the side designated 26. The conveyor device 18 has, in turn, transporting clamps 22 which are arranged at regular intervals one behind the other on a drawing element 20 which is driven in circulation at the conveying speed $v_2$ in the conveying direction $F_2$. In the receiving region 16, the movement path of the transporting clamps 22 has a slight downward slope, as can be seen in FIG. 3, with the result that the movement path 22' passes at an acute angle through the conveying plane defined by the belt conveyor 10 and strap conveyor 10'. As seen in plan view, the conveying direction $F_2$ of the conveying device 18 is the same as the conveying direction $F_1$ of the belt conveyor 10, and the conveying speeds $v_1$ and $v_2$ are likewise identical. In addition to a speed component in the direction of the conveying device 18, the conveying speed $v_1'$ of the strap conveyor 10' has a component which is directed in the conveying direction $F_1$ and $F_2$ and corresponds to the conveying speed $v_1$ and $v_2$. As a result, the leading edges 14' of the articles 14 maintain their spacing relative to one another and the articles 14 are moved in the direction of the conveying device 18 with the side edge 14" in front.

By means of the strap conveyor 10', in each case two articles 14 are moved one after the other, with the side edge 14" in front, into an open transporting clamp 22, where they come into abutment against a stop 32 by way of their side edge 14". As a result, the side edges 14" are aligned with one another again. The respectively two articles 14 are gripped, and conveyed further, by the corresponding one transporting clamp 22. As a result of the downward slope of the movement path 22' of the transporting clamps 22, the bottom clamp tongue 24 in each case is positioned on the top large-face side of the rear articles 14 gripped by the preceding transporting clamp 22, with the result that the next article 14 fed in each case from the strap conveyor 10' comes into abutment against said clamp tongue 24, as is indicated in FIG. 3.

Figure 4:
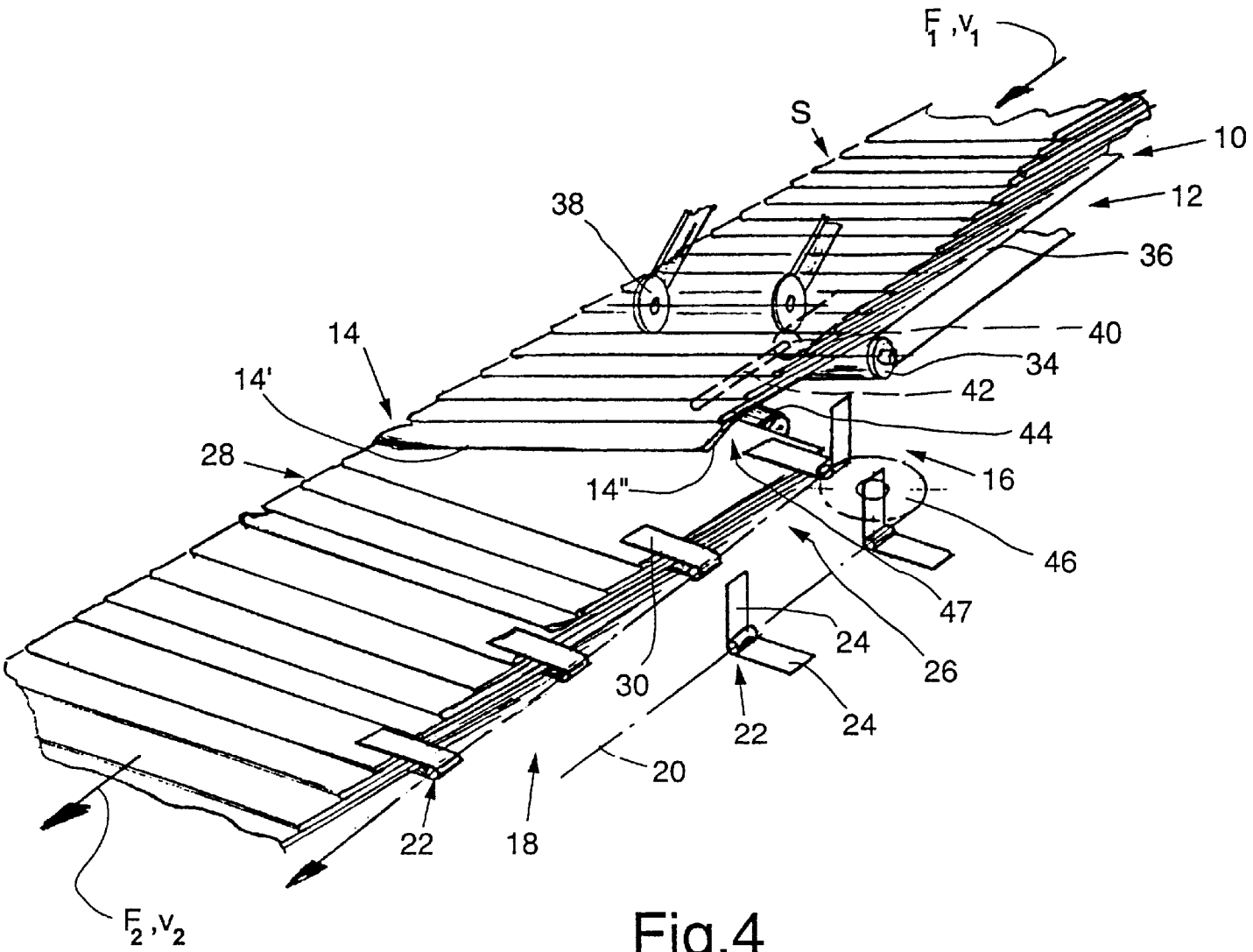
FIG. 4 shows a perspective illustration of a third embodiment of the apparatus, the conveying planes of the feed conveyor and of the conveying device being inclined in relation to one another.

The feed conveyor 12 of the apparatus shown in FIG. 4 likewise has a belt conveyor 10, although this is positioned obliquely in the transverse direction. It is driven continuously at the conveying speed $v_1$ in the conveying direction $F_1$ and is intended for feeding to the receiving region 16, which is arranged at the downstream end of the belt conveyor 10, the articles 14 arranged in the imbricated formation S, in which each article rests on the respectively preceding one. A weighting-roller pair 38 is arranged above the deflecting roller 34 for the conveying belt 36 of the belt conveyor 10, at the downstream end thereof. Said weighting-roller pair ensures that the articles 14 are only discharged to the conveying device 18 when they are released by way of their trailing edge, as seen in the conveying direction $F_1$, from the conveying nip formed by the conveying belt 36 and the weighting-roller pair 38.

The belt conveyor 12 is assigned—in its half which is located at the top as a result of the oblique positioning—a cylinder/piston subassembly 40, of which the piston is connected to a supporting rod 42 which, following the discharge of in each case one section 28 of articles 14 to the conveying device 18, can be extended from a rest position, in which it is located at the end of the belt conveyor 10, in the conveying direction $F_1$ into a supporting position, which is indicated by chain-dotted lines, and then drawn back again.

As seen in the conveying direction $F_1$, the feed conveyor 12 is adjoined by the conveying device 18, which has, on the one hand, a central supporting belt 44 and, on the other hand, on the side designated 26, the receiving region 16 has a clamp-type transporter. The latter, in turn, is provided with a drawing element 20 which is driven in circulation at the conveying speed $v_2$ in the conveying direction $F_2$ and on which individually controllable transporting clamps 22 are fastened at regular intervals one behind the other. On the receiving-region side, the drawing element 20 is guided around a deflecting wheel 46 with a vertical axis. As seen in the direction transverse to the identically directed conveying directions $F_1$ and $F_2$, the conveying planes defined by the belt conveyor 10 and by the conveying device 18 enclose an acute angle, and they intersect at a straight line which runs in the conveying direction and coincides at least more or less with the lower-level side edge of the articles 14 transported by the belt conveyor 10. The clamp-type transporter is arranged on the side of the higher-level side edge 14" of the articles 14 arriving. One clamp tongue 24 moves in the conveying plane of the conveying device 18 and the second, moveable clamp tongue 24 is directed, in the open position of the transporting clamps 22, in the upward direction at least more or less at right angles to said conveying plane and, in the closed position, parallel to the other clamp tongue 24.

Once in each case one section 28 of articles 14, which in the example shown comprises four articles 14, has been released by virtue of leaving the conveying nip formed by the conveying belt 36 and the weighting-roller pair 38, and has thus come into abutment against one clamp tongue 24 of the relevant transporting clamp 22 and the supporting belt 44, the supporting rod 42 is extended from its rest position into the supporting position, which is shown by dashed lines. This produces, in the direction transverse to the conveying plane, a gap 47 between the articles 14 fed from the belt conveyor 10 and the articles 14 discharged to the conveying device 18. By virtue of the other clamp tongue 24 being pivoted into said gap 47, the transporting clamp 22 is closed and, by virtue of deflection about the deflecting wheel 46, one clamp tongue 24 of the next-following transporting clamp 22 is moved into the gap 47, and, in the case of articles 14 which are long in the conveying direction, said clamp tongue comes into abutment against the exposed large-face side of the rearmost article gripped by the preceding transporting clamp 22, as FIG. 4 shows. The supporting rod 42 is then drawn back into the rest position counter to the conveying direction $F_1$, as a result of which the next section of the continuously fed articles 14 is discharged into the associated open transporting clamp 22. The gap 47 is then formed again by the supporting rod 42 subsequently being extended. All the articles 14 of one section 28 are thus retained by a single transporting clamp 22 and maintain their relative positioning at the same time. This apparatus may also be used to process irregular imbricated formations S. All that is required is for it to be ensured that all the articles 14 are gripped by the respectively one transporting clamp 22. For this purpose, a transporting clamp 22 is preferably pivoted into the receiving region 16 in each case at least more or less at the same time as the supporting rod 42 is extended.

Figure 5:
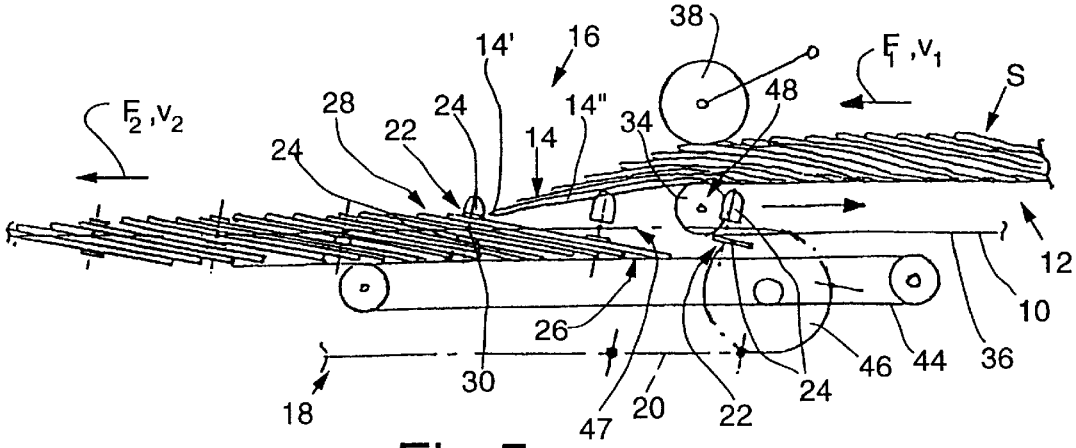
FIG. 5 shows a side view of a fourth embodiment of the apparatus, with a feed conveyor which is designed as a belt conveyor and of which the moveable end is located in the starting position.
Figure 6:
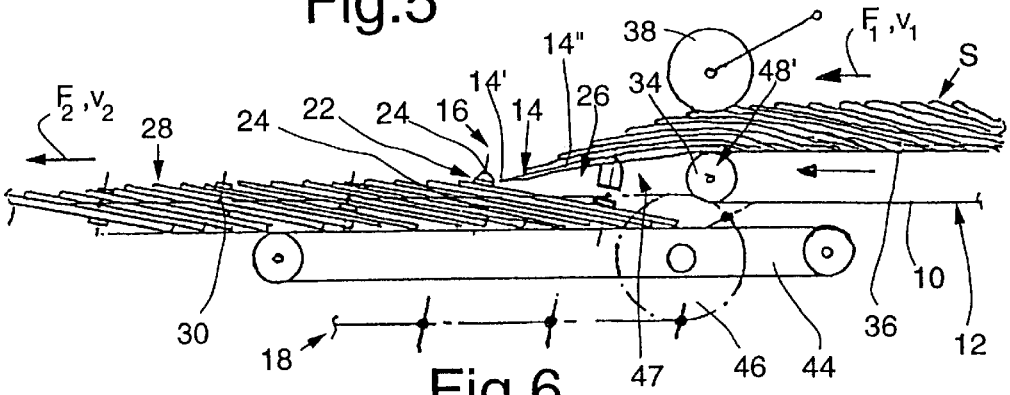
FIG. 6 shows, in the same illustration as FIG. 5, the apparatus shown in FIG. 5, the end of the feed conveyor having been moved into a drawn-back position for discharging products to the conveying device.

It is also the case with the apparatus shown in FIGS. 5 and 6, as with the apparatus shown in FIG. 4, that the feed conveyor 12 and the conveying device 18 are arranged in a line one behind the other. However, the conveying plane defined by the feed conveying 12, which is designed as a belt conveyor 10, in contrast to the apparatus according to FIG. 4, is parallel to the conveying plane of the conveying device 18. The deflecting roller 34 at the downstream end of the belt conveyor 10 can be moved, together with the associated weighting-roller pair 38, from a starting position 48, which is shown in FIG. 5, counter to the conveying direction $F_1$ into a drawn-back position 48', which is shown in FIG. 6, and back again. For the purpose of compensating for the change of length of the strands of the conveying belt 36 as a result of this movement, the return strand is guided in the form of an S around two rollers, one of these rollers being mounted in an stationary manner and the other roller, which is arranged between the stationary one and the deflecting roller 34, being moved along with said deflecting roller.

The belt conveyor 10 is intended for feeding continuously at the conveying speed $v_1$, in the conveying direction $F_1$, the articles in the imbricated formation S, in which, in turn, each article rests on the preceding one.

Arranged beneath the deflecting roller 34 and in the centre of the belt conveyor 10 as seen in the transverse direction, is a supporting belt 44 of the conveying device 18, said supporting belt extending beyond the receiving region 16 in and counter to the conveying direction.

Furthermore, the conveying device 18 has a drawing element 20 which is driven in circulation at the conveying speed $v_2$, which corresponds to the conveying speed $v_1$ in the conveying direction $F_2$ and on which individually controllable transporting clamps 22 are arranged at a distance one behind the other. At the upstream end, the drawing element 20 is guided around a deflecting wheel 46 with a horizontal axis, with the result that the conveying strand is at a higher level than the supporting belt 44 and is located on that side of the receiving region 16 which is designated 26.

Each transporting clamp 22 has two clamp tongues 24 which can be pivoted individually, for example in a manner controlled by a guide means, from a rest position, in which they are located in a passive position in a plane running in the conveying direction and at right angles to the conveying plane, into an active position, in which they project into the movement path of the articles 14 from the side 26.

The functioning will now be described from the starting position 48 of the belt conveyor 10, this position being shown in FIG. 5. The bottom clamp tongue 24 of the transporting clamp 22 which is intended for receiving the next section 28 of articles 14, and has moved into the receiving region 16 in the conveying direction $F_2$, is pivoted into the active position, in which it butts against the top, exposed large-face side of the rearmost article 14 of that section 28 which is retained, and conveyed away, by the immediately preceding transporting clamp 22. In this case, the transporting clamp 22 is located, as seen in the conveying direction F, approximately in the centre of the foremost article 14 of the imbricated formation S arriving. The deflecting roller 34 is then moved back into the drawn-back position, which is shown in FIG. 6, as a result of which four articles 14 are ejected onto the conveying device 18. Thereafter, the deflecting roller 34 is advanced again, at the conveying speed $v_1$, into the starting position 48—without discharging any further articles 14. As a result, a gap 47 is formed between the last article 14 discharged and the next-following article 14 which is still assigned to the belt conveyor 10, the top clamp tongue 24 being pivoted into said gap, into the active position, in order to secure the fed section 28 of four articles 14 for further transportation. At the same time, in turn, the bottom clamp tongue 24 of the next-following transporting clamp 22 is positioned on the top large-face side of the rearmost article 14 of the section which has just been gripped, whereupon the next-following section 28 can be transferred to the conveying device 18. The articles 14 of a section are, in turn, retained by a single transporting clamp 22 in a lateral clamping region 30, in which the relevant articles 14 overlap.

Figure 7:
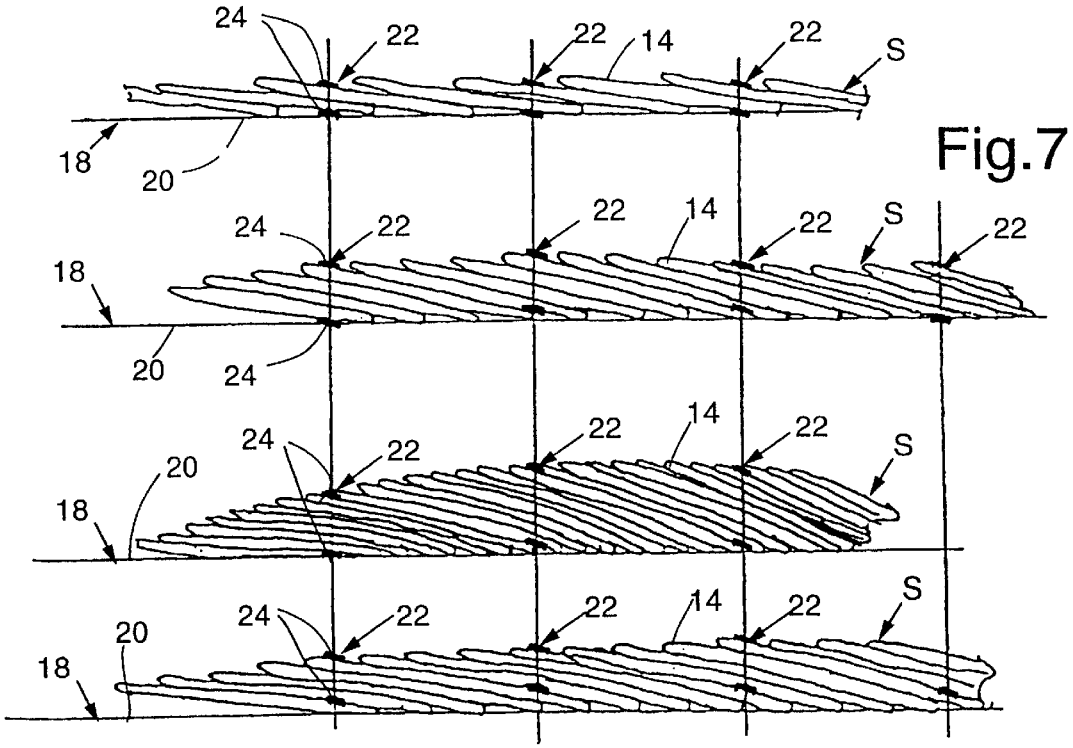
FIG. 7 shows a side view of four different imbricated streams which can be transported by means of the apparatus shown in FIGS. 5 and 6.

It can be seen from FIG. 7 that the apparatus shown in FIGS. 5 and 6 can be used to process different imbricated streams S which arrive. This figure shows the same part of the conveying device 18 four times, one beneath the other, the vertical lines indicating the position of the transporting clamps 22. In the top variant, each transporting clamp 22 has gripped two articles 14, for further-transportation purposes, laterally in the clamping region 30, which is located within the overlapping region of said articles. In the variant second from the top, each section comprises four successive articles 14, all the articles 14 of one section 28 being retained by a single transporting clamp 22. It can be seen from the third variant that it is possible to process irregular imbricated formations S. A section 28, which is retained by a single transporting clamp 22, contains precisely the same number of articles 14 as are discharged by the belt conveyor 10 during one operating cycle of the movement of the deflecting rollers 34 or, in other words, the same number of articles as arrive in a cycle of the conveying device 18. The lowermost variant indicates that it is possible to process articles 14 of different formats—in relation to the top variants. The articles shown in this case are larger in the conveying direction F than the articles of the variants shown above.

Figure 8:
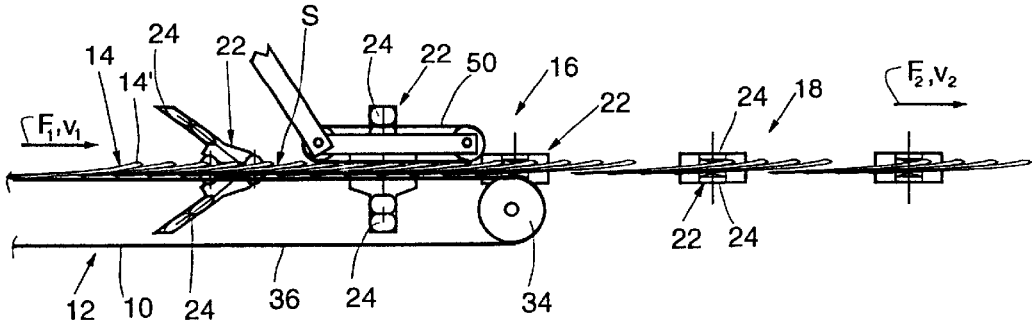
FIG. 8 shows a side view of a fifth embodiment of the apparatus, it being possible for the distance between successive transporting clamps to be changed.
Figure 9:
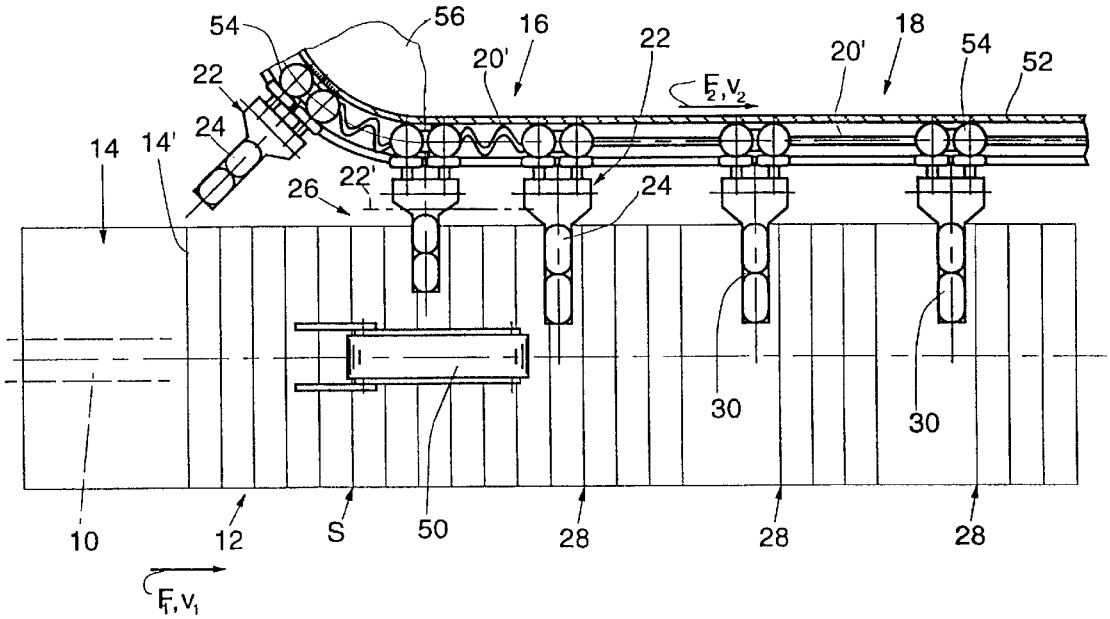
FIG. 9 shows a plan view of the apparatus according to FIG. 8.

In the apparatus shown in FIGS. 8 and 9, the feed conveyor 12 has a belt conveyor 10 and a pressure-exerting belt 50 arranged above the belt conveyor 10. The end of the active region of the pressure-exerting belt 50 is set back somewhat in relation to the end of the belt conveyor 10. The feed conveyor 12 is intended for feeding to the receiving region 16 at the conveying speed $v_1$, in the conveying direction $F_1$, the articles arranged in the imbricated formation S.

The conveying device 18 has transporting clamps 22 which are each fastened on a carriage 54 guided in a known manner in a channel 52. The carriages, which are arranged one behind the other, are connected to one another by a flexible drawing means 20', which may be part of an endless drawing element 20 in each case. The channel 22 runs in an arc in the direction of the receiving region 16 and, in said region, runs in the conveying direction $F_1$ on the side designated 26. In the present case, the arc is a sector of an arc of a circle and the position of the transporting clamps 22 located in the region of the arc is defined by a spur wheel 56 driven in the conveying direction $F_2$, the distance between successive transporting clamps 22 being smaller than the straightened-out length of the drawing means 20', which is thus depicted in undulating form. Downstream of the receiving region 16, the transporting clamps 22 are driven, for example, likewise by means of a spur wheel, the transporting clamps 22 being moved with a dragging action between the receiving region 16 and said drive.

As can be seen, in particular, from FIG. 8, each transporting clamp 22 has two clamp tongues 24, which can be moved symmetrically in relation to the conveying plane, about an axis running in the direction of the channel 52, from a spread-apart, open position, in the receiving region 16, towards one another into a closed position. The movement path 22' of the transporting clamps 22 is located, in the receiving region 16, in the conveying plane defined by the feed conveyor 12.

A transporting clamp 22 with clamp tongues 24 located in the open position is conveyed round the arc in each case into the receiving region 16, the imbricated formation S being enclosed from the side 26. As soon as the transporting clamp 22 has reached the downstream end of the pressure-exerting belt 50, the clamp tongues 24 thereof are moved into the closed position and the transporting clamp 22 is accelerated as a result of the dragging action, in the conveying direction $F_2$. This results in the, in the present case, four articles 14 which form a section 28 being carried along, while maintaining their positioning relative to one another, and in the overlapping between the rearmost of these articles and the next-following article, which is prevented from being carried along by the pressure-exerting belt 50, being reduced. This ensures that the next-following transporting clamp 22 will not additionally grip the articles 14 retained by the immediately preceding transporting clamp. Here too, the articles 14 of a section 28 are retained laterally in a clamping region 30, in which all the articles overlap.

Figure 10:
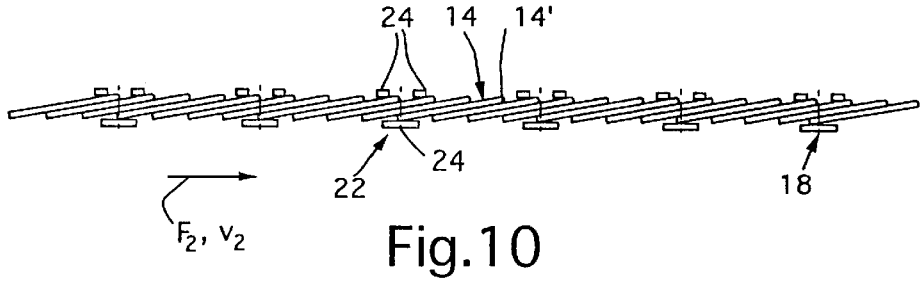
FIG. 10 shows a side view of transporting clamps of a conveying device which convey the retained articles in the imbricated stream.
Figure 11:
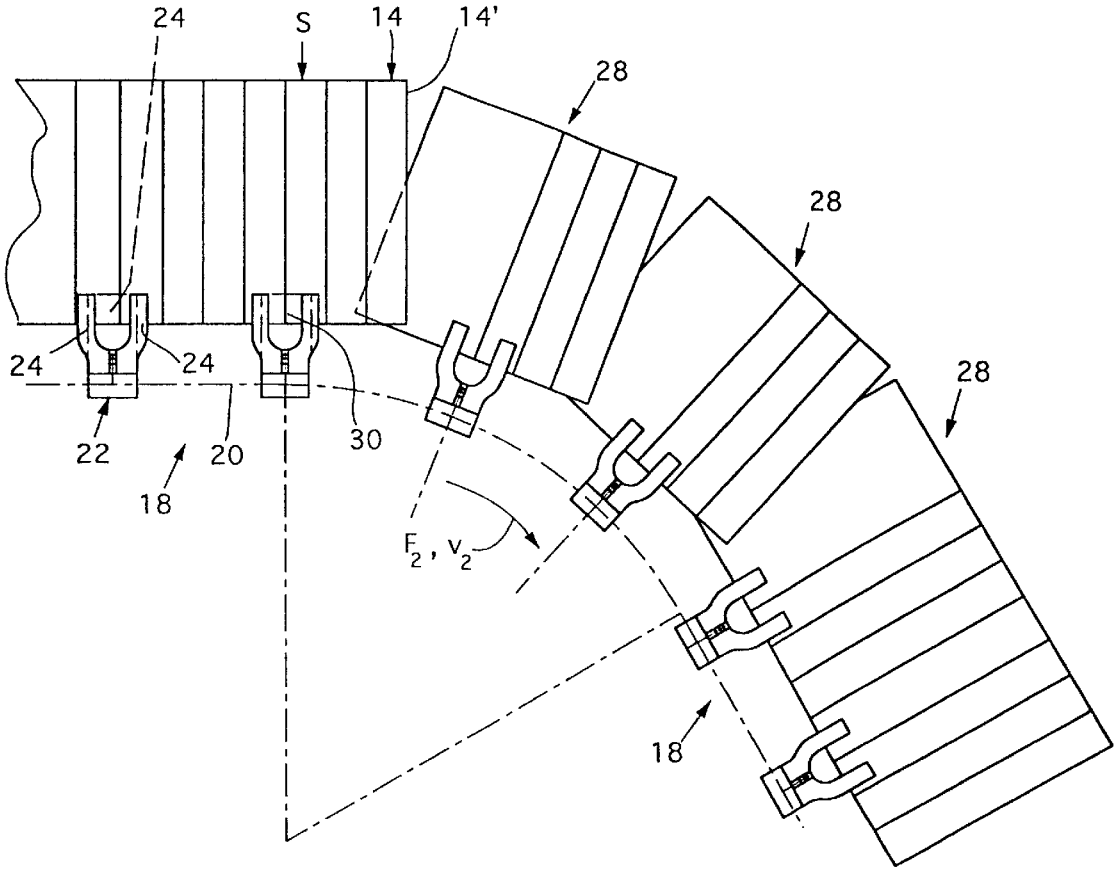
FIG. 11 shows a plan view of the embodiment shown in FIG. 10 with the articles being conveyed round a bend.

FIGS. 10 and 11 show a conveying device 18 with transporting clamps 22 which are arranged at a distance one behind the other on a drawing element 20 driven in the conveying direction $F_2$. Each transporting clamp 22 has a flat-surface-area, approximately rectangular bottom clamp tongue 24 and a top clamp tongue 24 of forked design. Each of the transporting clamps 22 retains a section 28 of four articles 14. In a rectilinear part of the conveying device 18, the articles 14 form a regular imbricated formation S. As can be seen from FIG. 11, the articles 14 of one section, as they run round bends located in the plane of the imbricated formation S, are moved in relation to the articles of the adjacent sections, although they maintain their positioning relative to one another within a section.

Figure 12:
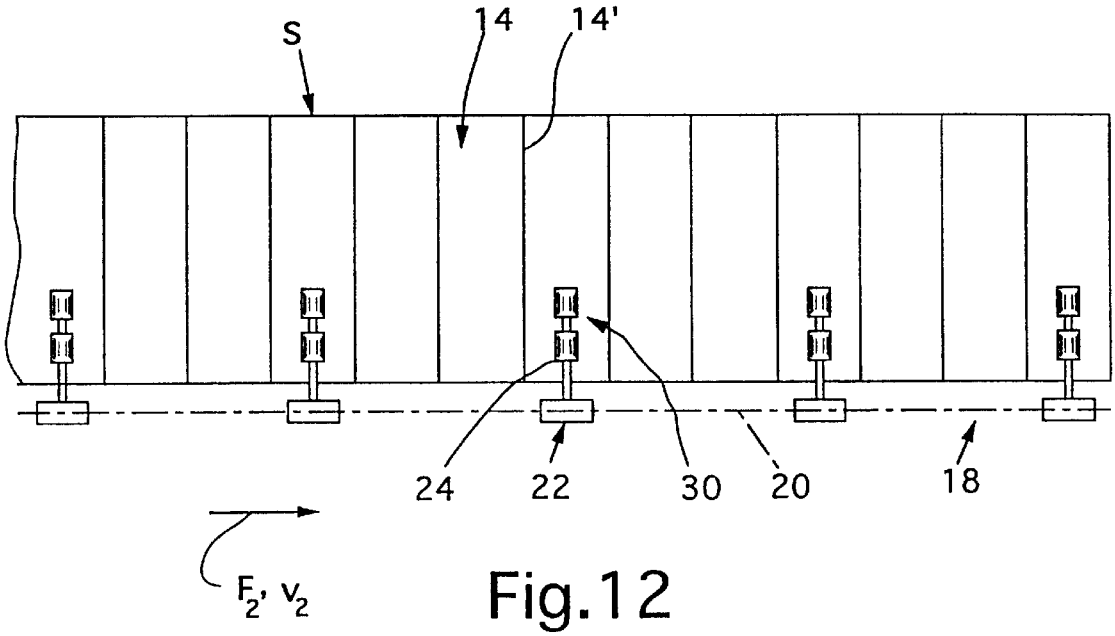
FIG. 12 shows a plan view of a further embodiment of the conveying device with articles being transported in the imbricated stream.
Figure 13:
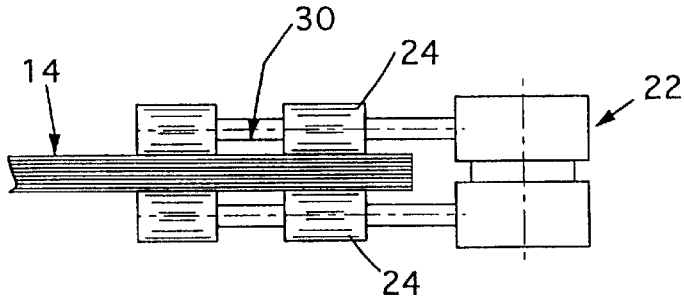
FIG. 13 shows a view of a transporting clamp of the conveying device according to FIG. 12.

FIGS. 12 and 13 show part of a further possible embodiment of the conveying device 18. Transporting clamps 22 are once again spaced apart on a drawing element 20 which is driven in circulation, the clamp tongues 24 of said transporting clamps in this case being formed by shanks which, in two parts, are provided with a covering, for example made of rubber. Instead of a flat-surface-area clamping region 30, as is the case with the embodiments shown above, the clamping region 30 is of linear form here. In this case too, each transporting clamp 22 retains a plurality of, in the example shown three, articles in the clamping region 30 from the side, each section 28 formed in this way being retained by a single transporting clamp 22.

It is also conceivable for a transporting clamp 22 to have two clamps located opposite one another, with the result that the articles 14 of a section are retained on both sides, as seen in the conveying direction. It is also the case here, however, that these clamps only retain articles of the same section 28.

It is also possible for the transporting clamps to be arranged on individual carriages which can be retrieved individually and are guided on a rail. Said individual carriages can be driven, for example, by magnetic coupling to a continuously driven drive element. As far as the construction and functioning of such an embodiment are concerned, you are referred to the earlier Switzerland Patent Applications 1997 2962/97; 1997 2963/97; 1997 2964/97 and 1997 2965/97.

Depending on the distance between the transporting clamps, the design of the transporting clamps, the distance between mutually corresponding edges of the articles and the format of the articles, it is possible for a section to have different numbers of articles.

The sections may be discharged from the conveying device 18 such that an imbricated formation which is the same as the arriving imbricated formation is reformed. It is also possible for the discharge operation to take place section by section such that the sections maintain their positioning relative to one another which they assume in the region of the conveying device; see FIGS. 1, 8 and 9.

What is claimed is:

1. A process for the further conveyance of sheet-like articles, such as printed products, arriving in an imbricated stream, in which in each case at least two of the articles arriving are gripped by a transporting clamp and, while retained by said clamp, are conveyed further, including the step of:

gripping the at least two articles laterally, as seen in the conveying direction, by one transporting clamp in a clamping region in which at least one overlapping region of said articles is located, each of said two articles being gripped by just one transporting clamp.

2. The process according to claim 1, characterized in that:

the at least two articles are gripped by the transporting clamp in the clamping region, which is spaced apart from the leading edge of the foremost and from the trailing edge of the rearmost of the at least two articles.

3. The process according to claim 2, characterized in that:

the articles which are to be gripped by the transporting clamp maintain their positioning relative to one another as seen in the conveying direction of the transporting clamp, which they assume in the imbricated stream.

4. The process according to one of claim 1, 2, or 3, characterized in that:

between the articles which are gripped by the transporting clamp and the articles which are to be gripped by a following transporting clamp, a gap is formed or, with a reduction in the overlapping, there is an increase in the distance between mutually corresponding edges of the articles, said edges running transversely to the conveying direction.

5. An apparatus for the further conveyance of sheet-like articles, such as printed products, arriving in an imbricated stream, comprising:

a feed conveyor for transporting the articles in the imbricated stream to a receiving region, and a conveying device which is arranged downstream of the feed conveyor and has individually controllable transporting clamps which are arranged one behind the other in the conveying direction and are adapted to grip, in the receiving region, in each case at least two of the articles arriving and convey said articles further, the movement path of the transporting clamps running on one side of the receiving region, as seen in the conveying direction, and the feed conveyor and the conveying device being coordinated with one another such that the in each case at least two articles which are to be gripped by a transporting clamp are gripped laterally in a clamping region, in which at least one overlapping region of said articles is located, the feed conveyor and the conveying device also being coordinated with one another so that each of said two articles is gripped by just one transporting clamp.

6. The apparatus according to claim 5, characterized in that:

the feed conveyor has a belt conveyor, and the movement path of the transporting clamps, in the receiving region, is located approximately in the conveying plane defined by the belt conveyor.

7. The apparatus according to claim 5, characterized in that:

the conveying device has means for increasing, at the end of the receiving region, the distance between the transporting clamp which has gripped articles and the following transporting clamp intended for receiving the following articles.

8. The apparatus according to claim 5 or 6, characterized in that:

the conveying direction of the feed conveyor and the conveying direction of the conveying device enclose an acute angle, the feed conveyor is adapted to convey the articles in an imbricated stream in which the leading edge of the articles runs at least more or less at right angles to the conveying direction of the feed conveyor, and each of the transporting clamps is adapted to grip in each case at least two of the articles while the latter maintain their positioning relative to one another.

9. The apparatus according to claim 5 or 6, characterized in that:

the conveying direction of the feed conveyor and the conveying direction of the conveying device enclose an acute angle, the feed conveyor is adapted to convey the articles in an imbricated stream in which edges of the articles run approximately parallel to the conveying direction of the conveying device, the conveying device has a stop which is formed by the respective transporting clamp and against which the articles which are to be gripped by the transporting clamp come into abutment by way of said edge, and the transporting clamps are adapted to grip the articles, which are aligned with one another by way of the edge.

10. The apparatus according to claim 5, characterized in that:

in the conveying region, the conveying direction of the feed conveyor and the conveying direction of the conveying device are approximately the same, the conveying plane of the conveying device is included in the direction transverse to the conveying direction in relation to the conveying plane of the feed conveyor, and the movement path of the transporting clamps runs on that side on which the higher-level side of the feed conveyor is located.

11. The apparatus according to claim 5 or 6, characterized in that the feed conveyor has a belt conveyor, of which the receiving-region end is arranged above the conveying device.

12. The apparatus according to claim 5, characterized in that:

the transporting clamps are individually retrievable for the purpose of gripping the articles.

13. The apparatus according to claim 11, characterized in that:

for the respective discharge of the at least two articles, the receiving-region end of the feed conveyor is adapted to be moved counter to the conveying direction from a starting position into a drawn-back position, and then back again.

* * * * *

UNITED STATES PATENT AND TRADEMARK OFFICE

CERTIFICATE OF CORRECTION

PATENT NO. : 6,736,391 B1
DATED : May 18, 2004
INVENTOR(S) : Walter Reist

It is certified that error appears in the above-identified patent and that said Letters Patent is hereby corrected as shown below:

Title page,
Item [56], References Cited, FOREIGN PATENT DOCUMENTS, delete "2417612" and substitute -- 2417614 --.

Signed and Sealed this

Twenty-fourth Day of January, 2006

JON W. DUDAS
*Director of the United States Patent and Trademark Office*